United States Patent [19]

Jonathan

[11] Patent Number: 4,993,302

[45] Date of Patent: Feb. 19, 1991

[54] NON SLIP GUITAR PICK

[76] Inventor: Fred F. Jonathan, 100 Wyandotte Ave., Buffalo, N.Y. 14207

[21] Appl. No.: 367,743

[22] Filed: Jun. 19, 1989

[51] Int. Cl.[5] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 655,959 | 8/1900 | Cochrane | 84/322 |
| 1,184,561 | 5/1916 | Napoletano | 84/322 |
| 1,254,577 | 1/1918 | Carpenter | 84/322 |
| 1,573,912 | 2/1926 | Burdwise | 84/322 |
| 3,595,118 | 7/1971 | Paxton | 84/322 |
| 4,102,234 | 7/1971 | Brundage | 84/322 |
| 4,122,746 | 10/1978 | Freeman | 84/322 |
| 4,137,814 | 2/1979 | Rowley | 84/322 |
| 4,150,601 | 4/1979 | Henley | 84/322 |
| 4,347,773 | 9/1982 | Zook | 84/322 |
| 4,691,609 | 9/1987 | Acocella | 84/322 |
| 4,711,150 | 12/1987 | Hyduck | 84/322 |
| 4,790,227 | 12/1988 | Lukehart | 84/322 |

FOREIGN PATENT DOCUMENTS

| | | | |
|---|---|---|---|
| 16608 | of 1894 | United Kingdom | 84/322 |

*Primary Examiner*—Lawrence R. Franklin

[57] ABSTRACT

A thin flat piece of plastic that can be repeatedly bent. Two thin soft pieces of rubber are attached to the hard flexible plastic with glue. The soft flexible material is thinly coated with a non-hardening adhesive. The pick is held between the thumb and forefinger when being used.

4 Claims, 2 Drawing Sheets

NON SLIP GUITAR PICK

BACKGROUND OF THE INVENTION

This invention relates to a pick for the plucking of the strings of a guitar.

When using a pick to play a guitar, a problem often arises, namely, the guitarist finds it is difficult to hold the pick firmly between the thumb and forefinger. Either the pick moves back and forth or it is dropped. Both affect the way the instrument is played and, ultimately, the guitarist's concentration on the music he or she is playing Many picks have been developed in an attempt to remedy the problem. Some picks have cork attached to the flat sides, but this made the pick too thick and unwieldly. Other picks have had finger receiving indentations provided on said sides. While these solutions have been helpful, none have completely eliminated the problem.

Accordingly, an object of the invention is to prevent or minimize the tendency of a guitar pick to shift relative to the holding fingers when the guitarist is playing the guitar.

SUMMARY OF THE INVENTION

The disclosed invention comprises a guitar pick consisting of a flat piece of hard flexible material having glued on each of its major surfaces a soft non-slip material with a non-hardening adhesive applied to their outer surfaces. The combination of the non-slip material and the non-hardening adhesive provides essentially a non-slip coaction between the pick and the thumb and finger holding the pick.

FIG, 4 is an exploded perspective view of the pick.

DETAILED DESCRIPTION OF THE INVENTION

The preferred embodiment of the invention is illustrated in FIG. 1 –4. The pick has a main body 1 made of a hard flexible material which can be repeatedly bent without fracturing. Preferably body 1 is made of plastic but it can be made of any other suitable material, such as, polyethylene, polypropylene, vinyl, nylon, or rubber. It is formed into a relatively uniform thickness of virtually any thickness. The material and the thickness of body 1 determines the rigidity of the pick.

Figure 1:
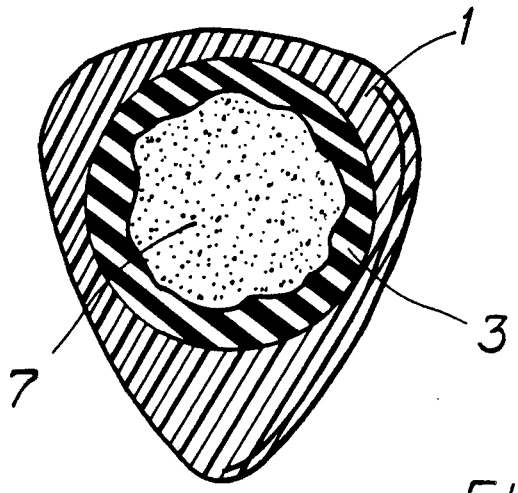
FIG. 1 is a front view of the pick.
Figure 4:
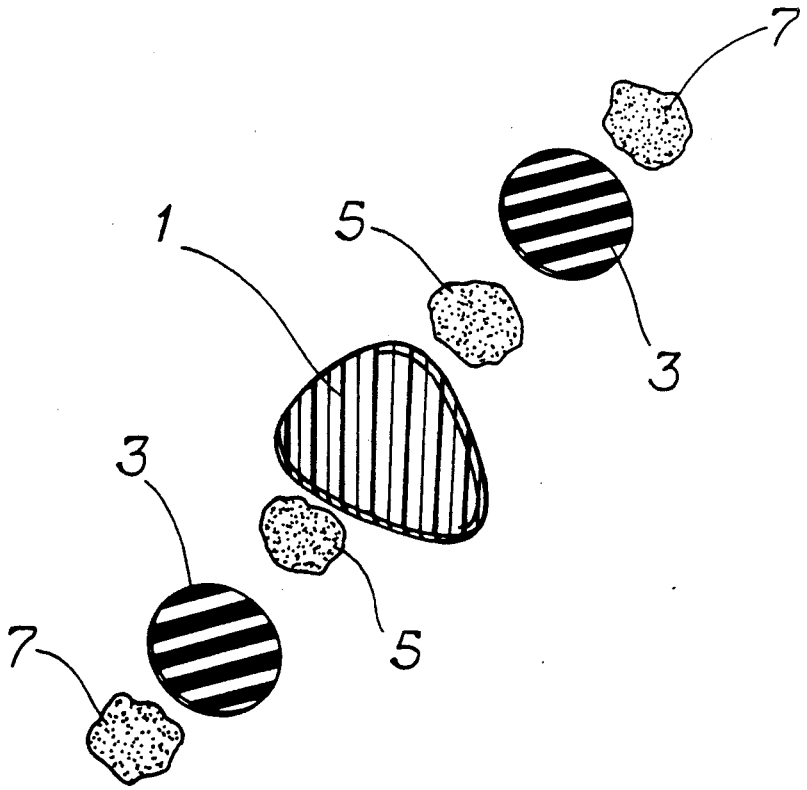
Figure 3:
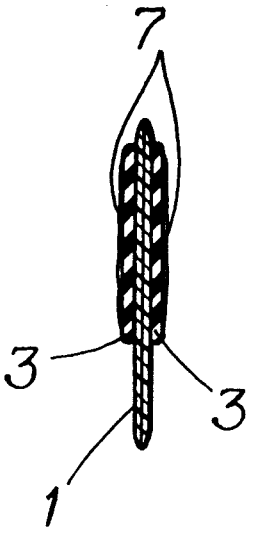
FIG. 3 is a side view of the pick.
Figure 2:
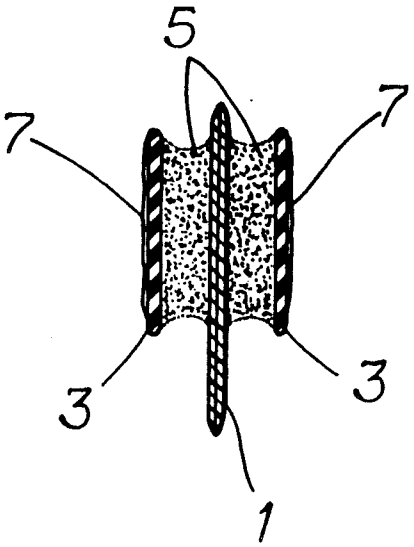
FIG. 2 is an exploded side view of the pick.

A piece of non-slip material 3, preferably a piece of flexible and durable rubber of approximately 1/64 inch thickness, is attached to each major surface of the pick by means of a suitable glue 5. FIG. 2 shows a side view of the pick immediately before attachment; FIG. 3 shows the assembled pick. I have found that by applying a thin coat 7 of "Elmers Stix All Adhesive"outside of the non-slip material, the adhesive will not harden. After adhesive 7 is allowed to set for 24 hours, the pick can be used. When held between the thumb and forefinger, a small amount of heat is created which makes the stix All slightly tacky. It is this slight stickiness, along with the rubber, which prevents most movement of the pick in the hand.

I claim:

1. A non-slip string plucking device, comprising:

a main body consisting of a piece of hard, flexible material which can be repeatedly bent without fracturing;

at least one piece of soft, flexible material attached to a major surface of said main body; and a non-hardening adhesive thinly coated on the outside of said at least one piece of soft, flexible material.

2. The plucking device of claim 1 wherein a piece of soft, flexible material is attached to both major surfaces of said main body.

3. The plucking device of claim 1 wherein said plucking device is a guitar pick.

4. The plucking device of claim 1 wherein said main body is of a relatively uniform thickness.

* * * * *